United States Patent [19]

Anschutz

[11] 4,055,912

[45] Nov. 1, 1977

[54] TOY CONSTRUCTION MEMBERS

[75] Inventor: Hans-Josef Anschutz, Berlin, Germany

[73] Assignee: Anschutz Handels-und Verwaltungs-GmbH, Berlin, Germany

[21] Appl. No.: 655,225

[22] Filed: Feb. 4, 1976

Related U.S. Application Data

[63] Continuation of Ser. No. 408,916, Oct. 23, 1973, abandoned, which is a continuation of Ser. No. 121,268, March 5, 1971, abandoned.

[30] Foreign Application Priority Data

Mar. 7, 1970 Germany ..... 2010896

[51] Int. Cl.[2] ..... A63H 33/08

[52] U.S. Cl. ..... 46/25; 52/591; 52/594

[58] Field of Search ..... 46/25, 26, 30, 31; 52/590, 591, 594

[56] References Cited

U.S. PATENT DOCUMENTS

| | | | |
|---|---|---|---|
| 3,310,906 | 3/1967 | Glukes | 46/26 X |
| 3,415,007 | 12/1968 | Höwe | 46/25 X |
| 3,623,261 | 11/1971 | Freese | 46/30 |
| 3,667,153 | 6/1972 | Christiansen | 46/30 |
| 3,852,909 | 12/1974 | Viebcke | 46/25 X |

FOREIGN PATENT DOCUMENTS

| | | | |
|---|---|---|---|
| 564,917 | 8/1958 | France | 46/30 |
| 6,609,260 | 1/1968 | Netherlands | 52/590 |
| 607,838 | 9/1948 | United Kingdom | 46/30 |

*Primary Examiner*—F. Barry Shay

[57] ABSTRACT

A structural assembly for toy construction sets comprising a unitary frame of open geometric shape and a cover member for sheathing the opening. At least the frame and possibly the cover member is provided with interengaging elements. The elements on the frame comprise at least, two rows of alternating tabs and recesses, one row being offset from the other by one element so that a tab and recess are aligned. When the rows are located on the cover member the elements are arranged on the face of the cover.

6 Claims, 9 Drawing Figures

INVENTOR
HANS-JOSEF ANSCHÜTZ

BY Thomas Schraff
ATTORNEY

INVENTOR

HANS-JOSEF ANSCHUTZ

BY Thomas Schaffer

ATTORNEY

TOY CONSTRUCTION MEMBERS

This is a continuation of application Ser. No. 408,916, filed Oct. 23, 1973, now abandoned, which is itself a continuation of Ser. No. 121,268, filed Mar. 5, 1971, now abandoned, claiming priority for German Appl. 2010896.7, filed Mar. 7, 1970 for which all equitable and legal rights are claimed.

BACKGROUND OF THE INVENTION

The present invention relates to structural members for toy and model construction and building sets.

Many types of toy construction sets are known, whose structural members are interconnected to each other by interengaging parts. Conventional so-called "insertion" members carry mating elements only on a pair of opposite surfaces or edges. Thus, one surface may be provided with a groove shaped receptacle while the other surface with resilient insertable projections or pins. The cross section of these connecting elements may be different. The arrangement and distribution of these connecting elements is chosen in such a manner that they may be assembled in a variety of predetermined relationship. Such toy structural elements are limited in their manner of assembly in only two directions. For example, if an upright or vertical wall is built it is only possible to connect to it another upright wall at right angles to it. A horizontal branching such as a floor cannot be connected to it.

It has been attempted to overcome this shortcoming by the use of structural members having interengaging elements on more than two surfaces, so as to permit extension of the structure in a third direction. Because these structural members cannot be used for the normal vertical wall it has been necessary to employ special members at the point where horizontal branching is wanted. Because these structural members must be assembled in connecting with the normal members the horizontal connection must be precisely determined before construction of a model. This, however, is not readily possible in building toy models. It also frequently occurs that a completed model must be enlarged in a horizontal direction with rebuilding of the model. This is not possible with the known structural members.

In another known construction toys, rod shaped frame parts and cover plates are employed. The frame parts carry connecting elements and can be assembled to form complete structural frames. The open side of the frames are then covered with the plates which may be inserted within the framework. Structures can be formed in all directions with the rods since they have connecting elements on all sides; however, once the rods are joined it is no longer possible to provide a horizontal branch to a vertical branch and vice-versa. This is a severe limitation of this form of construction toy. Futhermore, the unit size of a structure built with these members is determined by the size of the frames so that a model similating true structural features cannot be erected.

Similar conditions exist in building with completely finished members which in general, the flat plate shaped members have groove and tongue connections. An additional problem in this construction is that the connecting joint must be filled with filler material (glue, grout) and closed similar to natural construction. In these constructions there is no possibility of providing for the addition of horizontal branches.

It is thereore, an object of the present invention to provide a structural member for toys or model construction sets which overcome the problems of the prior art.

It is also an object of the present invention to provide a structural member by which horizontal branching can be made even in a finished structure, by using other identical structural elements.

It is also an object of the present invention to provide a structural member which permits a complete structure to be readily changed and provided with branching members without the disassembly of the structure.

It is a further object to provide a structural member which may be connected with other structural members in any direction and orientation.

It is also an object of the present invention to provide a structural element which is simple and which can be manipulated easily by children.

These and other objects and advantages will be apparent from the following description.

SUMMARY OF THE INVENTION

According to the present invention a structural assembly for toy construction sets comprising a unitary frame of open geometric shape and a cover member for sheating the opening. At least the frame and possibly the cover member is provided with interengaging elements. The elements on the frame comprise at least, two rows of alternating tabs and recesses, one row being offset from the other by one element so that a tab and recess are aligned. When the rows are located on the cover member the elements are arranged on the face of the cover.

Preferably, the interengaging elements are symmetrically arranged and conform in size and shape to each other so that two or more assemblies may be assembled.

Preferably, the members of the assembly are made of hard plastic with very low resiliency so that a tight functional fit may be obtained. Foamed resins may be used.

Full details of the present invention are set forth in the following description and in the accompaying drawings.

BRIEF DESCRIPTION OF THE DRAWINGS

In the accompanying drawings:

As seen in FIG. 1 the frame member 10 comprises a geometric planar member having edge surfaces and a generally open or free interior. The edge surfaces are smooth. In the embodiment of FIG. 1 there is arranged, along the center line of each side of the frame, two rows of interengageable elements which extend outward perpendicular to the plane of the edge surface. The two rows are arranged adjacent each other and have alternating projecting tabs 11 and 24 and recesses 14 and 21 respectively. The height of the tabs and the depth of the recesses conform or are matched to the thickness of the frame edge supports so as to maintain strength and integrity in the frame. The tabs and the recesses conform to each other and fully occupy a single longitudinal division of each row. As seen in the illustration each row is divided into four parts, two being occupied by tabs and two by recesses. The actual number of divisions will, of course, depend on the length of the side of the selected size of tabs and recesses.

The two rows are offset one from the other by one division, so that a tab 11 is offset opposite a recess 21, for example. When the outer surfaces of the frames in a set are symmetrically arranged it is possible to assemble two frames in any desired position without fear of lateral, translatory or axial shifting. The frames may overlap each other by one-half their width when assembled and still be firmly held together.

Figure 1:
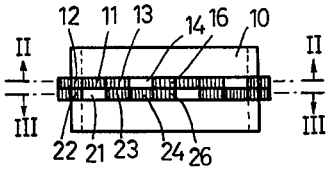
FIG. 1 is a top plan view of a member having an outer frame surface carrying two rows of interengageable elements at its center, according to the present invention.
Figure 2:
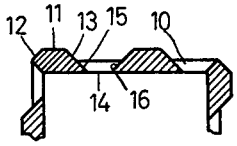
FIG. 2 is a section along line 2—2 of FIG. 1.
Figure 3:
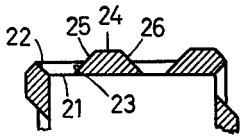
FIG. 3 is a section along line 3—3 of FIG. 1.

The sections according to FIGS. 2 and 3 show the offset of the two rows of interengageable elements. As seen in FIG. 2 the total width of the frame is occupied by four divisions of alternating tabs 11 and recesses 24. Each tab 11 and recess 24 have the same width and depth. Each tab has inclined lateral surfaces 12 and 13 while each recess has lateral inclined surfaces 15 and 16. It will be observed that the surfaces 12 merge with the surfaces 16 while the surfaces 13 merge with the surfaces 15 and may be considered as serving both the tabs and recesses. The arrangement provides a firm frictional fit. The surfaces are inclined at an angle of 45° so that both elements have a trapezoidal section in the same plane. The tabs 11 taper in an outward direction extending perpendicularly above the surface 10 while the recesses taper in an inward direction below the level of the surface 10.

In FIG. 3 the tabs 24 and recesses 21 are similarly formed with inclined surfaces 25, 26 and 21, 23 respectively. Since this row is offset by one division from the row shown in FIG. 2 the row appears as an opposite hand arrangement.

Figure 4:
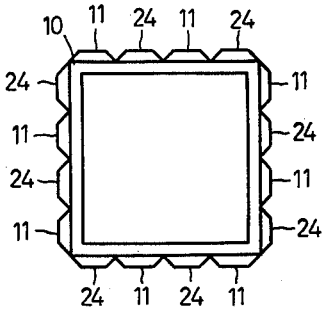
FIG. 4 is a lateral view of a square frame member having interengageable elements at each of its four edges.

In FIG. 4 a square or quadrilateral frame 10 is shown having interengageable elements along each edge. As will be evident from this lateral view the projecting tabs of one row and tabs of the other row alternate. While the recesses are not seen in this figure their alternate arrangement will also be evident. The arrangement is such, of course, that the alternation of the tabs and recesses continues completely around the frame and because of the symmetry of the frame provides alternate elements even at the corners and even with respect to elements arranged on opposed edges. Thus, it will be obvious that such frames may be readily interconnected with each other in all relative positions. Frames of this nature may be continuously arranged with each other in all directions because the distribution of the interengageable elements is not changed when the frame 10 is turned. Since each frame edge has four divisions the interconnected frame may be offset or shifted relative to each other by one-half the width of the frame.

Figure 5:
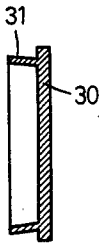
FIG. 5 is a sectional view of a cover plate for the member of FIG. 4.

A cover plate 30, seen in FIG. 5 is provided to cover or sheath the frame 10. The shape of the cover plate 30 is adapted to conform to that of the frame 10. The plate 30 carries on one side elements 31 which engage the free interior of the frame 10 by frictional engagement to be held thereon as desired, and on the other side with a finished surface suitable for the construction model. The cover plate 30 is preferably made with an over hanging lip portion so as to completely sheath the frame and hide the seam or separation between the interengageable elements.

Both the frame and cover plate may be made of different shapes than the square one shown in FIG. 4. Thus, rectangles, triangles, squares, other polygons, trapezoids, equilateral and non-equilateral triangles and other geometric forms having different side lengths may be produced. It is preferable, however, that at least one side of the figure has two or four divisions. Multiples greater than four and other combinations of even numbersdivision are also possible.

Figure 6:
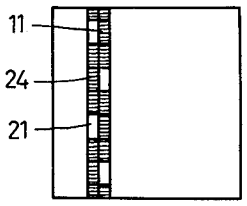
FIG. 6 is a top plan view of a cover plate for the member of FIG. 4 having interengageable elements.
Figure 7:
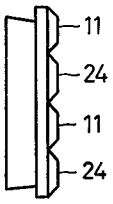
FIG. 7 is a side view of the plate according to FIG. 6.

As seen in FIGS. 6 and 7 the face of the cover plate 30 for a frame 10 may itself be provided with interengageable elements on its outer surface. In these facial interengageable elements the tabs and recesses are arranged in rows and are similarly constructed and offset as the same elements 11, 14, 21 and 24, previously described and match the arrangement and distribution of the elements on frame 10. The facial rows, however, need not be centered on the plane of the cover plate 30 and since the cover plate may be set into the frame 10 in any one of four positions (i.e., by turning it about its central axis) subsequent branching from the cover plate may be made either in a horizontal or vertical direction. Furthermore, since the frame 10 has an open interior and is capable of receiving cover plate 30 on both sides, the branching may be effected on either or both sides of the structural wall or form which has been built. By selectively exchanging smoothly sheathed cover plates 30 (FIG. 5) for cover plates having facial interengageable elements (FIG. 6) various vertical, horizontal and other branching arrangements can be accomplished. This can be done even after a model or building has been constructed since the replacement of one cover plate for another quickly restores the integrity of the model, and the same is accomplished without disturbing the frame structure.

Figure 8:
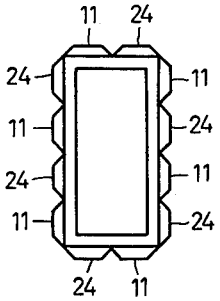
FIG. 8 shows a rectangular frame.

FIG. 8 shows a rectangular frame 10 in which the long sides have four divisions and the short sides have two divisions. The interengageable elements are again symmetrically arranged so that the tabs 11 and the offset tabs 24 alternate continuously about the entire circumference. This frame member is compatible with that shown in FIG. 4 and may be arranged with it into any model structure. A rectangular cover plate may be provided with or without facial elements.

Figure 9:
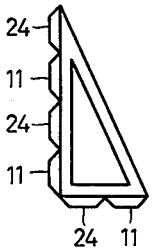
FIG. 9 shows a triangular frame.

The member shown in FIG. 9 has the shape of a right triangle having two elements on its short leg and four elements on its long leg. The hypotenuse is shown without engageable elements, although it, too, may be provided with them, if desired. The triangular member is provided with a conforming cover plate not shown, which may or may not be provided with the facial interengageable elements.

Since in each form of the frame, be it rectangular, polygonal, triangular etc., the interengageable elements are symmetrical, complementing and conforming. Any assemblage of frames and cover plates can be made with any variety of different shapes.

The construction of the frame members and facial cover plates is not limited to two rows or interengageable members. It is possible to assemble the members with a symmetrical and conforming arrangement having more than two rows. Furthermore, the rows of elements need not necessarily be arranged along the center of the surface but may, as indicated for the cover plate, be offset. Conversely, the row of elements on the cover plate may be placed in the center or even diagonally if desired. The interengageable elements may be placed in two non-contiguous rows anywhere across the depth of the edges of the frame or cover plate. In this event it may be preferable to arrange them symmetrically on opposite sides of the center line. The interengageable elements may be formed along the corners of the edge surfaces of the frame rather than along the center line. When this is done the recess portions face the outer surfaces and is left open to view. This facilitates the manufacture of the frame by injection molding of plastic material since the mold or die does not require movable parts for forming the recesses below the surface of the edge. Preferably, the frame and cover plate are made from hard plastic or similar material with some resiliency with a force fit between the tabs and recess.

The cover plates 30 may be provided with any finished surface desired to simulate building materials. This may be accomplished by embedding mineral particles in the plastic material or using other techniques. They may be molded to simulate brick, wood, terracotta or other finishes. Because the cover plates cover the entire frame it may be preferable to provide them with means such as an indentation or tab to facilitate their removal from the frame.

Corners of model or building structures are easily and neatly made when at least one edge of the frame is maintained smoothly without interengaging elements. Thus, a straight edge is formed along the corner.

It will thus be seen that the present invention provides a very versatile assembly for toy or model construction. The various frame elements may be easily assembled into a variety of forms and many different frame shapes may be used to obtain as near perfect a model as is possible. The cover platees without interengaging elements permit the structure to have a natural appearance.

The cover plates with interengaging elements permit a wide variety of vertical and horizontal branches to be made. Floors, roofs, etc., can be constructed easily and without the need to destroy already built structures. Cover plates are readily interchangeable and may be used to cover both faces of the frame.

The structure formed is rigid and strong because of the frictional fit of the interengaging elements and of their trapezoidal shape. Because the tabs and recesses are at right angles to the surface of the frame, the frames are closely interlocked and mate squarely and firmly.

The assembly parts are economical and simple to make. Because hard low elastic resin plastics are preferred they have long life.

Many modifications have been disclosed; others will be obvious to those skilled in this art. The present disclosure is illustrative only of the invention.

What is claimed is:

1. A toy construction set comprising a plurality of members, each of said members comprising a unitary frame of open polygonal shape having outer peripheral planar edge surfaces and a planar cover member for sheathing the open side of said frame, said frame having two parallel rows of continuously alternating tabs and recesses located substantially along the center line of at least one of said edge surfaces, each of said rows comprising a plurality of adjacent alternating tabs raised perpendicularly from the plane of said edge surface and recesses conformed in depth to said tabs, said tabs and recesses being respectively below and over the plane defining said edge surface and being mutually conformed trapezoids of the same height and width with the tabs tapering inwardly in the outward direction at an angle of 45°, the tabs of one row being offset relative to the tabs of the other row by a distance equal to one of said tabs or recesses whereby two or more of said frames may be interconnected with the tabs and recesses of one interengaging with the conforming recesses and tabs of the other and the planar surfaces of the corresponding peripheral edges in abutment, said cover member being provided with tabs are recesses on its surface which are adapted to interconnect with the tabs and recesses of said frames.

2. The construction set according to claim 1 wherein the tabs and recesses are arranged about the entire circumference of said frame.

3. The construction according to claim 1 wherein said rows of tabs and recesses are contiguous to each other.

4. The construction according to claim 1 wherein said rows of tabs and recesses are distributed symmetrically to either side of the longitudinal center line of said edge surface.

5. The construction set according to claim 1, wherein said cover member is provided with interiorly directed engaging projections adapted to enter into and seal against said frame.

6. The construction set according to claim 1, wherein said frame and cover member are plastic.

* * * * *